US006530538B2

(12) United States Patent
Trimborn et al.

(10) Patent No.: US 6,530,538 B2
(45) Date of Patent: Mar. 11, 2003

(54) WINDING DEVICE FOR A TEXTILE MACHINE THAT PRODUCES CHEESES

(75) Inventors: Detlev Trimborn, Mönchengladbach (DE); Christian Sturm, Krefeld (DE); Peter Schwartz, Schwalmtal (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/932,147

(22) Filed: Aug. 17, 2001

(65) Prior Publication Data

US 2002/0020779 A1 Feb. 21, 2002

(30) Foreign Application Priority Data

Aug. 17, 2000 (DE) ..... 100 40 106

(51) Int. Cl.[7] ..... B65H 49/18; B65H 54/44

(52) U.S. Cl. ..... 242/596.5; 242/486.6; 242/486.8

(58) Field of Search ..... 242/485.3, 485.8, 242/486, 486.6, 486.8, 596.5, 131

(56) References Cited

U.S. PATENT DOCUMENTS

| | | | | | |
|---|---|---|---|---|---|
| 2,016,509 | A | * | 10/1935 | Nye | 242/486.6 |
| 2,930,538 | A | * | 3/1960 | Miller | 242/485.3 |
| 3,381,912 | A | * | 5/1968 | Huck | 242/596.5 X |
| 3,825,206 | A | | 7/1974 | Schippers et al. | 242/474.6 |
| 4,043,517 | A | * | 8/1977 | Jahrig | 242/486 |
| 4,394,987 | A | * | 7/1983 | Pedroia | 242/596.5 |
| 4,676,448 | A | * | 6/1987 | Koffer | 242/596.5 X |
| 5,101,856 | A | * | 4/1992 | Kakinuma et al. | 137/554 |
| 5,535,955 | A | * | 7/1996 | Enger et al. | 242/476.2 |
| 5,906,333 | A | * | 5/1999 | Fortuna et al. | 242/596.5 X |
| 6,311,919 | B1 | | 11/2001 | Hermanns et al. | 242/477.3 |

FOREIGN PATENT DOCUMENTS

| | | | | | |
|---|---|---|---|---|---|
| DE | 2 106 898 | | | 8/1972 | |
| DE | 2 313 152 | | | 3/1976 | |
| DE | 38 05 662 | C2 | | 9/1989 | |
| DE | 39 11 505 | A1 | | 10/1990 | |
| DE | 43 00 389 | A1 | * | 7/1993 | 242/596.5 X |
| DE | 43 00 389 | A1 | | 7/1993 | |
| DE | 43 36 312 | A1 | | 2/1995 | |
| DE | 43 30 647 | A1 | | 3/1995 | |
| DE | 198 36 701 | A1 | | 2/2000 | |
| DE | 198 58 548 | A 1 | | 6/2000 | |
| DE | 199 08 093 | A1 | | 8/2000 | |
| GB | 2 224 042 | A | * | 4/1990 | 242/486.8 X |
| JP | 63-267670 | A | | 2/1989 | |

OTHER PUBLICATIONS

European Search Report.

* cited by examiner

*Primary Examiner*—Kathy Matecki
*Assistant Examiner*—Minh-Chau Pham
(74) *Attorney, Agent, or Firm*—Kennedy Covington Lobdell & Hickman, LLP

(57) ABSTRACT

A winding device (24) for a textile machine (1) producing cheeses has a creel (18) for holding a cheese (11) between tube receiving plates (38, 38'), a yarn traversing device (28) comprising a separate drive (31), and a speed-regulatable drive device (27) integrated in the creel (18) to move in a bearing housing (23) of the creel (18) and connected to one of the tube receiving plates (38, 38'). The drive device (27) can be loaded with a braking current which produces a moment opposite the direction of rotation (SR) of the cheese (11), for braking the cheese (11). The drive device (27) is arranged in a sliding sleeve (35) that can be loaded pneumatically against the displacement force of spring elements (43) to move one of the tube receiving plates (38) outwardly as needed in a creel opening direction.

9 Claims, 4 Drawing Sheets

WINDING DEVICE FOR A TEXTILE MACHINE THAT PRODUCES CHEESES

CROSS REFERENCE TO RELATED APPLICATIONS

This application claims the benefit of German Application DE P 10040106.6, filed Aug. 17, 2000, herein incorporated by reference.

BACKGROUND OF THE INVENTION

The present invention relates generally to a winding device for a textile machine that produces cheeses of wound yarn and, more particularly, to such a winding device which comprises a creel having opposed tube receiving plates for holding a cheese tube therebetween, a yarn traversing device comprising a separate traversing drive, and a speed-regulatable drive device integrated in the creel for movement in a bearing housing of the creel and connected to one of the tube receiving plates.

Such winding devices for textile machines are generally known, e.g., in conjunction with the production of cheeses of "precision winding" and "step [stage] precision winding" types.

Subsequently published German Patent Publication DE 199 08 093.3 describes, e.g., a winding device in which a cheese held in a creel is directly driven by a drive motor integrated in the creel. The cheese rests on a pressure roller, sometimes referred to as a billy-roller, that is not driven itself. The traversing of the yarn to be wound takes place by means of a finger-like yarn guide loaded by a separate drive. The two drives can be controlled via an appropriate control device in such a manner that a defined, pre-selectable winding relationship, specifically a defined ratio, is always achieved.

Since a cheese must be brought to a standstill rather frequently in the overall course of winding a full cheese, e.g. when a feeding cop slows down, upon a yarn break or after a controlled yarn cleaner cut, the known winding device also comprises a pneumatically loadable braking device integrated in the cheese drive. This known braking device is comprised of a brake lining arranged on the stator housing and adapted to rotate in unison with said housing, against which brake lining a contact surface, designed as a brake disk, of a tube receiving plate can be pneumatically pressed. The braking force produced thereby rapidly brings the cheese to a standstill.

However, the known winding device has a number of disadvantages. Specifically, both the rotating brake disk and the stationary brake lining are subject to significant wear and are therefore relatively maintenance-intensive. In addition, the accumulating brake dust can readily pass into the axial sliding guide of the cheese drive as well as into the bearing of the electromotor and result in a breakdown of these components.

Moreover, winding devices are known, e.g. in German Patent Publication DE 198 36 701 A1 in which devices a grooved drum that drives the cheese and at the same time traverses the yarn is electrically braked to a standstill after the cheese has been lifted off the drum. To this end the drive motor of the grooved drum is loaded with a braking current that is usually a multiple of the rated nominal current of the drive motor.

SUMMARY OF THE INVENTION

Accordingly, in view of the above-described state of the art, it is an object of the invention to improve the known winding devices.

Basically, the present invention addresses this objective by a cheese winding device essentially comprising a creel having opposed tube receiving plates for holding a cheese tube therebetween for rotation in a winding direction, a yarn traversing device comprising a separate traversing drive, and a speed-regulatable drive device integrated in the creel. The drive device is arranged in a sliding sleeve mounted in a bearing housing of the creel and is connected to one of the tube receiving plates for movement pneumatically against a displacement force of spring elements for selective movement of one of the tube receiving plates outwardly in a creel opening direction. A braking arrangement is also provided for loading the drive device with a braking current for braking the cheese by producing a moment opposite the direction of winding rotation of the cheese.

The present invention has the particular advantage that the braking device associated with the winding device, on the one hand, operates almost without wear and, on the other hand, reliably brakes the cheese in an extremely short time to a standstill. The spring elements that act on the sliding sleeve that receives the drive device assure that the cheese tube held non-positively between the tube receiving plates is held in a very largely slip-free manner during acceleration and also during braking. However, at the same time, the design of the invention also assures that the creel can be opened without problems at any time as needed. That is, the sliding sleeve, and therewith the drive device connected to one of the tube receiving plates, can be pneumatically loaded in such a manner that the sliding sleeve can be moved against the displacement force of a spring element into the bearing housing. The tube receiving plate concerned is shifted outward thereby so that the cheese tube of the cheese and therewith the cheese are reliably released.

In order to brake the cheese, the drive device is first loaded with a braking current by appropriately regulating an end stage, which braking current generates a moment counter to the direction of rotation of the cheese and can be a multiple of the rated current, if required. The braking moment generated thereby in the drive device assures that even large-volume cheeses are reliably braked to a standstill in an extremely short time.

In a preferred embodiment of the present invention, the drive device is designed as an electronically commutated direct-current motor whose rotor is directly connected to one of the tube receiving plates. A drive device designed in such a manner constitutes a compact, high-performance drive that is also distinguished by a good price/performance ratio.

Preferably, the sliding sleeve that receives the drive device is loaded by at least one spring element whose spring power is directed parallel to the axis of rotation of the drive device toward the middle of the creel. That is, the spring element assures that a cheese arranged between the tube receiving plates is reliably clamped.

It is further preferred that the spring elements are designed as helical springs and act on the sliding sleeve. The helical springs, preferably two, extend into corresponding receiving bores of the sliding sleeve and are supported on a stationary bearing housing wall. The movably supported sliding sleeve, in which the drive device is arranged, is permanently loaded, as already mentioned above, by spring elements in the direction of the middle of the creel. That is, the spring elements assure with a high pressing force that a cheese tube arranged between the tube receiving plates is reliably clamped at all times. The distribution or arrangement of the spring elements is selected in such a manner that an attack of force from one side and therewith a tilting of the sliding sleeve inside the bearing housing is excluded.

In addition, an advantageous embodiment of the invention provides that an annular space is located between the sliding sleeve receiving the drive device and the bearing housing of the creel, which space can be loaded in a defined manner with compressed air. That is, the sliding sleeve can be moved in such a manner against the spring power of the spring elements attacking the sliding sleeve by loading this annular space in a defined manner with compressed air that one of the tube receiving plates is shifted outward and as a result a cheese tube that was held up to that time between the tube receiving plates is released.

The annular space of the sliding sleeve is connected via an electromagnetic valve that is preferably designed as a 3/2-port directional control valve to a compressed-air source of the textile machine. The use of such a proven electromagnetic valve makes possible in a simple and reliable manner a defined control of the particular creel by means of a winding head computer. Thus, the sliding sleeve movably supported in a bearing housing of the creel can be pneumatically loaded in such a manner at any time as required that one of the tube receiving plates is actuated in a creel opening direction.

In order to also be able to open the creel manually, the previously described directional control valve also comprises a manual actuation control. It is possible to open the creel manually with this manual actuation independently of the winding head computer, e.g., to remove a specimen cheese.

Finally, an abutment is provided on the creel into which abutment a corresponding tool can be inserted. If necessary, the abutment makes possible a purely manual displacement of the sliding sleeve loaded by spring power, so that it is possible to open the creel even if the compressed air is lacking in the textile machine or if there is a significant drop in the compressed air.

Further details of the invention can be gathered below from an exemplary embodiment explained in the drawings.

DESCRIPTION OF THE PREFERRED EMBODIMENT

Figure 1:
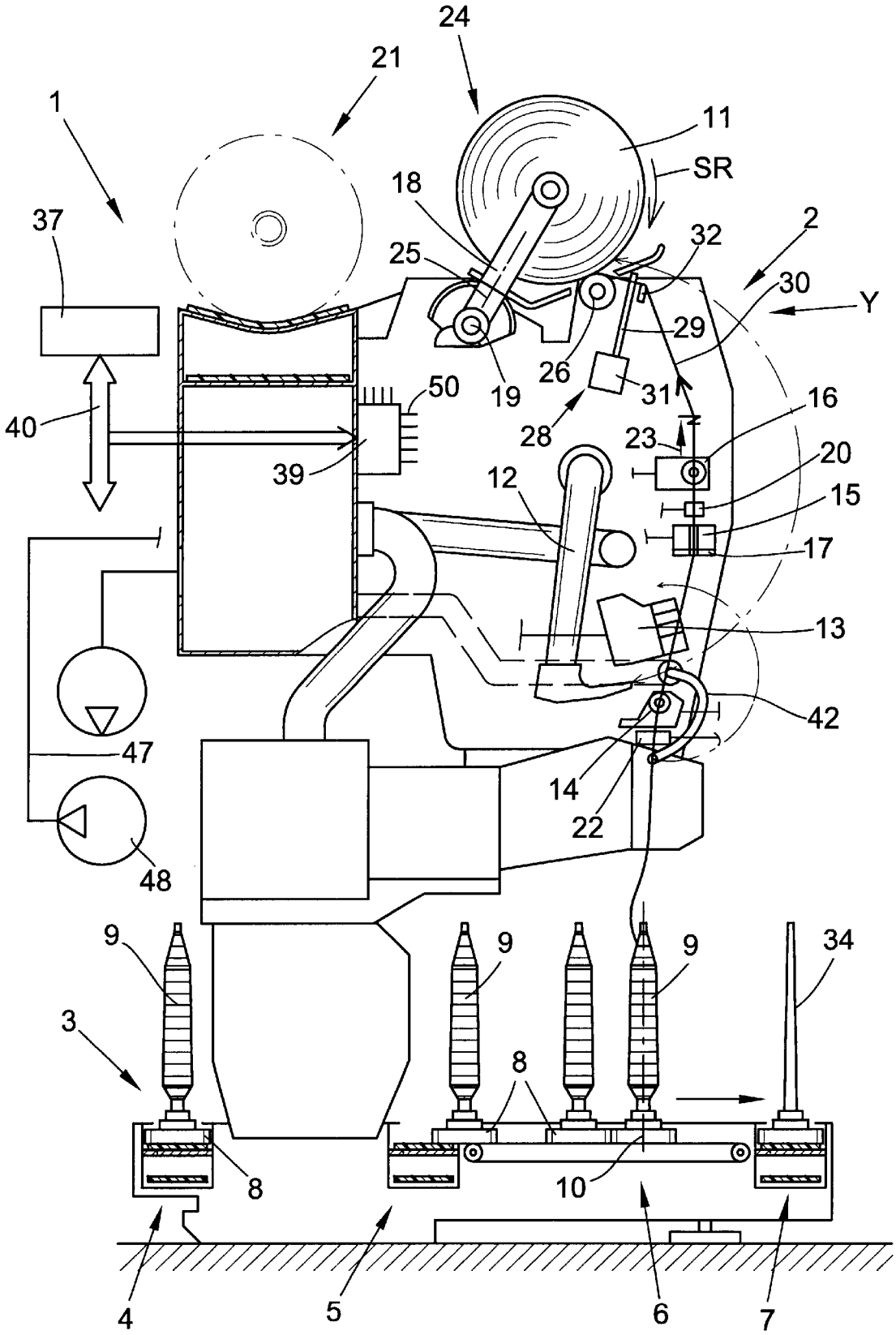
FIG. 1 is a side view of a work station of a textile machine producing cheeses in accordance with the present invention.

FIG. 1 schematically shows a side view of a textile machine that produces cheeses, identified in its entirety by reference numeral 1, of the type commonly referred to as an automatic cheese winder in the exemplary embodiment herein illustrated and described. Such automatic cheese winders customarily comprise a plurality of similar work stations, in the present instance winding heads 2, aligned with one another between the end frames of the machine (not shown).

Spinning cops 9 manufactured on a ring spinning machine are rewound at these winding heads 2 into larger-volume cheeses 11 in a manner that is known and therefore not explained in more detail. After they have been manufactured, cheeses 11 are transferred onto cheese transport device 21 running the length of the machine, e.g., by pivoting the winding head creel 18 about pivot axis 19, and the cheeses are then transported to a cheese loading station or the like (not shown) arranged at an end of the machine.

Moreover, such automatic cheese winders 1 customarily comprise a logistic device in the form of a cheese and tube transport system 3. Spinning cops 9 and empty tubes 34 supported in vertical disposition on transport plates 8 circulate within this logistic device. FIG. 1 shows only the following parts of known cheese and tube transport system 3: Cop feed stretch 4, storage stretch 5, which can be driven in a reversing manner, one of transversal transport stretches 6 running to winding heads 2, as well as tube return stretch 7. The spinning cops 9 thusly supplied are rewound into larger-volume cheeses 11 in unwinding position 10 located in the area along each transversal transport stretch 6 at winding heads 2.

In addition, such an automatic cheese winder comprises a central control unit 37 connected via machine bus 40 to the separate winding-head computers 39 of the individual winding heads 2.

Individual winding heads 2 comprise, as is known and therefore only schematically indicated, various devices that make possible an orderly operation of these work stations. In FIG. 1 a yam unwound from spinning cop 9 and traveling to cheese 11 is designated by reference numeral 30, a suction nozzle is designated by 12 and a grasping tube is designated by 42. Such winding heads 2 also comprises a splicing device 13, a yarn tensioning device 14, a yam cleaner 15, a paraffin application system 16, a yarn cutting device 17, a yarn tension sensor 20 and an underyarn sensor 22.

Moreover, the winding device, characterized in its entirety by reference numeral 24, comprises creel 18 supported in such a manner that it can move about pivot axis 19. Creel 18 can also be pivoted about axis 25, e.g., to manufacture conical cheeses.

During the winding process the driven cheese 11 rests with its surface on pressure roller 26 and in turn drives indirectly this pressure roller 26, that has no separate drive, via frictional contact therebetween . The cheese is driven via drive device 27 with speed control. This drive device 27, that is preferably designed as an electronically commutatable direct-current motor, is integrated in bearing housing 23 of creel 18, as can be seen from FIGS. 2 to 4.

Figure 2:
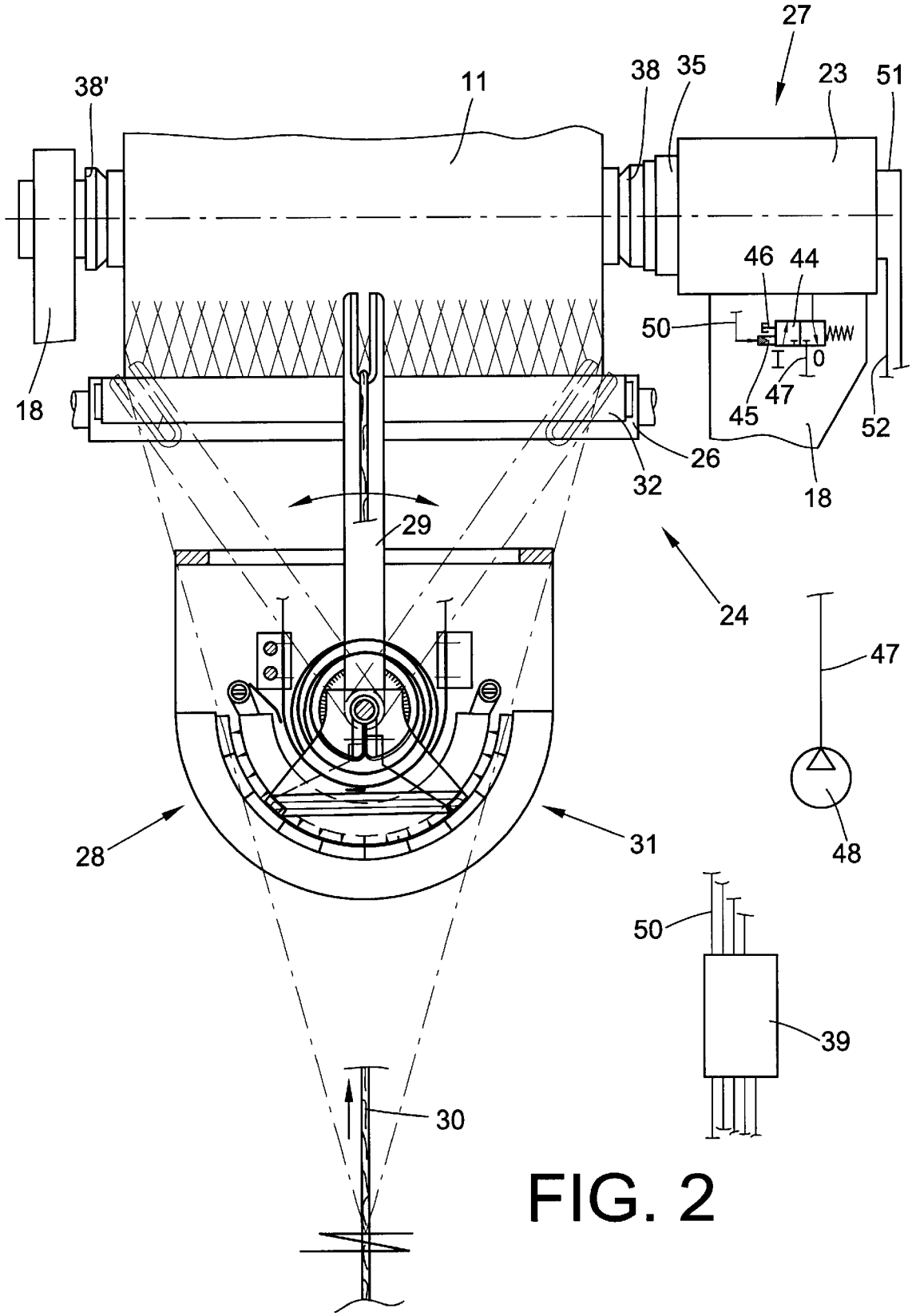
FIG. 2 is a front view of the winding device of the work station indicated in FIG. 1, as viewed along arrow Y in FIG. 1.

Yarn traversing device 28 is provided to traverse yarn 30 during the winding process. Such a traversing device indicated in FIG. 2 is described in detail, e.g., in German Patent Publication DE 198 58 548 A1. Yarn traversing device 28 basically comprises yarn guide 29 designed in the form of a finger, which guide, loaded by electromechanical drive 31, traverses yarn 30, as indicated in FIG. 2, between the opposite ends of cheese 11. Yarn 30 glides during its displacement by yarn guide 29 along guide arm 32. Drive device 27 for cheese 11, that is shown in section in FIGS. 3 and 4, is supported in an axially movable manner, as already indicated above, in bearing housing 23 of creel 18.

More specifically, stator 33 of drive device 27 is fixed in sliding sleeve 35 running inside bearing housing 23 in such a manner that it can move axially but is adjusted so that it can rotate in unison by a torque locking mechanism 36. Spring elements 43 act on sliding sleeve 35 to load sliding sleeve 35 in the direction of the lengthwise center of the creel.

Annular space 41 is located between bearing housing 23 and sliding sleeve 35, which space is connected via a pneumatic line to an electromagnetic valve, preferably a 3/2-port directional control valve 44. The 3/2-port directional control valve comprises switching magnet 45 as well as manual control 46, and is connected via pneumatic line 47 to compressed-air source 48.

Figure 3:
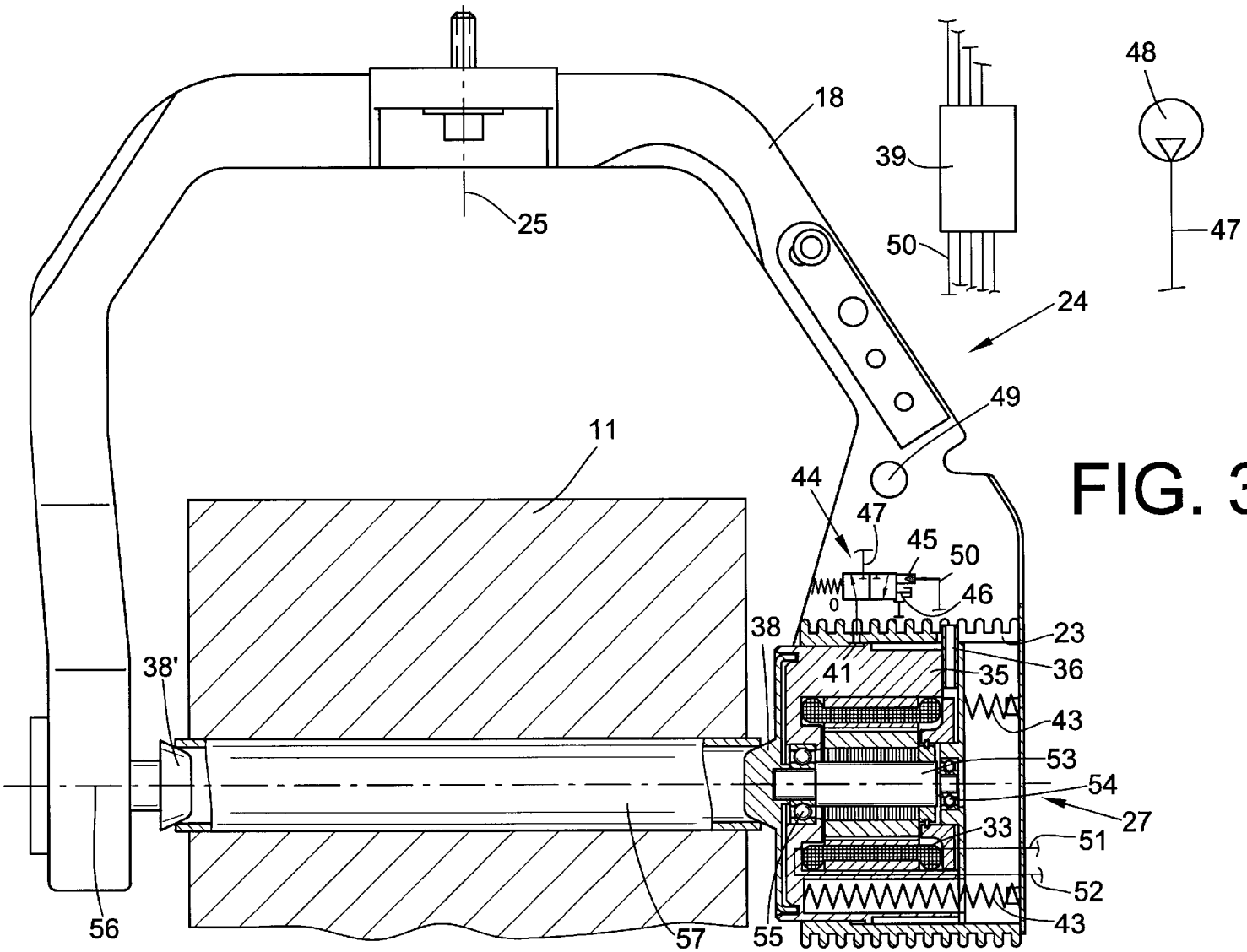
FIG. 3 is a top view of the creel of the winding device of FIGS. 1 and 2 showing the creel in a closed state and the drive device in section.
Figure 4:
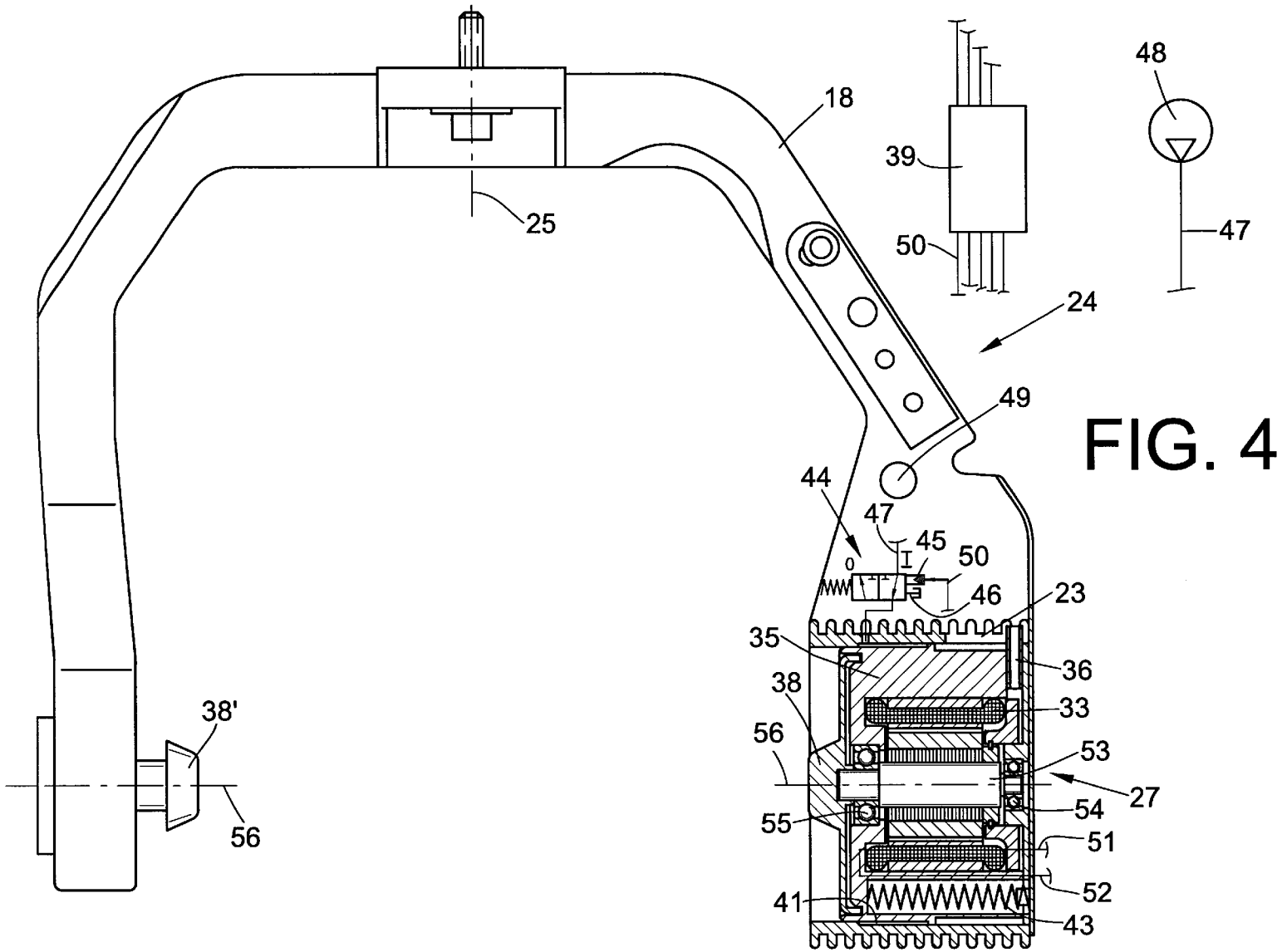
FIG. 4 is another top view of the creel of the winding device of FIGS. 1 and 2, similar to FIG. 3 but showing the creel in a closed.

As is indicated in FIGS. 3 and 4, the windings of stator 33 of electronically commutated drive device 27 are connected via direct-current leads 51, 52 to a source of direct current (not shown). In addition, tube receiving plate 38 is connected so as to rotate about an axis 56 in unison with rotor 53 supported in bearings 54, 55. This tube receiving plate 38 fixes a tube 57 of cheese 11 non-positively in cooperation with the other tube receiving plate 38'.

The operation of the device may thus be understood. During a normal ongoing winding operation, cheese 11 fixed non-positively between tube receiving plates 38, 38' is rotated by drive device 27. Thus, tube receiving plate 38 connected to rotor 53 of drive device 27 rotates in the desired direction of yarn winding onto the cheese, indicated by arrow SR in FIG. 1, thereby entraining cheese tube 57. Tube receiving plate 38 is loaded so strongly thereby by spring elements 43 attacking sliding sleeve 35 in the direction of the creel frame that a reliable frictional connection is assured between tube receiving plates 38, 38' and cheese tube 57 during the acceleration of cheese 11 as well as during the braking of the cheese.

As is indicated in FIG. 2, 3/2-port directional control valve 44 is in switching position "0" during the ongoing operation of normal winding, whereby no pneumatic pressure is applied to annular space 41 located between sliding sleeve 35 and bearing housing 23.

When cheese 11 has reached its prescribed diameter and must be replaced, drive device 27 is first loaded with a braking current and cheese 11 is electrically braked to a standstill by the braking moment thereby produced. Then, 3/2-port directional control valve 44 is actuated into switching connection "I", as is shown in FIG. 4, so that annular space 41 is connected to compressed-air source 48. The compressed air flowing into the annular space 41 presses sliding sleeve 35 back into bearing housing 43 against the spring tension of spring elements 43 so that cheese tube 57, which theretofore has been clamped between tube receiving plates 38, 38', comes out of contact with tube receiving plates 38, 38'. Cheese 11 can now be readily removed from creel 18.

The 3/2-port directional control valve 44 is customarily controlled by winding-head computer 39 through its connection via control lead 50 to switching magnet 45 of electromagnetic valve 44. In addition, in order to also be able to replace cheese 11 manually, if necessary, e.g., for a winding cheese specimen or the like, manual control 46 is also provided on 3/2-port directional valve 44 via which control 46 the valve 44 can be shifted manually into switching position "I".

Moreover, in order that creel 18 of winding head 2 can also be opened manually, e.g., in the case of a general drop in compressed air, abutment 49 is located on the creel. A lever-like tool can be inserted into this abutment 49 and the sliding sleeve thereby may be shifted even without compressed air into the bearing housing; that is, the creel is manipulated in a creel opening direction. The level tool corresponds with a corresponding shoulder on the sliding sleeve.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A winding device for a textile machine for producing cheeses of wound yarn, comprising a creel having opposed tube receiving plates for holding a cheese tube therebetween for rotation in a winding direction, a yarn traversing device comprising a separate traversing drive, a speed-regulatable drive device integrated in the creel, the drive device being arranged in a sliding sleeve mounted in a bearing housing of the creel and being connected to one of the tube receiving plates for movement pneumatically against a displacement force of spring elements for selective movement of one of the tube receiving plates outwardly in a creel opening direction, and a braking arrangement for loading the drive device with a braking current for braking the cheese by producing a moment opposite the direction of winding rotation of the cheese.

2. The winding device according to claim 1, characterized in that the drive device comprises an electronically commutated direct-current motor having a rotor connected to one of the tube receiving plates of the creel.

3. The winding device according to claim 1, characterized in that at least one of the spring elements acts on the sliding sleeve to exert a spring tension directed parallel to the axis of rotation of the drive device.

4. The winding device according to claim 3, characterized in that the spring elements comprises helical springs.

5. The winding device according to claim 1, characterized in that an annular space is arranged between the sliding sleeve and the bearing housing for loading of the annular space in a defined manner with compressed air.

6. The winding device according to claim 5, characterized in that the annular space is connected via an electromagnetic valve to a source of compressed air.

7. The winding device according to claim 6, characterized in that the electromagnetic valve comprises a 3/2-port directional control valve which comprises an electrically controllable switching magnet and a manual control.

8. The winding device according to claim 7, characterized in that the switching magnet is adapted to be programmably controlled via a winding-head computer.

9. The winding device according to claim 1, characterized in that the creel includes an abutment into which a corresponding tool is insertable for manual displacement of the sliding sleeve against the spring elements in the absence of a sufficient pneumatic force to move the drive device.

* * * * *